US006732707B2

(12) United States Patent
Kidokoro et al.

(10) Patent No.: US 6,732,707 B2
(45) Date of Patent: May 11, 2004

(54) CONTROL SYSTEM AND METHOD FOR INTERNAL COMBUSTION ENGINE

(75) Inventors: Toru Kidokoro, Hadano (JP); Keizo Hiraku, Susono (JP); Hiroshi Kanai, Susono (JP); Toshiki Annoura, Nagoya (JP); Hideki Suzuki, Chita-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 96 days.

(21) Appl. No.: 10/108,635

(22) Filed: Mar. 29, 2002

(65) Prior Publication Data

US 2002/0157639 A1 Oct. 31, 2002

(30) Foreign Application Priority Data

Apr. 26, 2001 (JP) ..... 2001-129725

(51) Int. Cl.[7] ..... F02D 7/00

(52) U.S. Cl. ..... 123/396; 123/399; 123/442; 123/319

(58) Field of Search ..... 123/395, 396, 123/399, 442, 319

(56) References Cited

U.S. PATENT DOCUMENTS

| | | | | |
|---|---|---|---|---|
| 5,366,424 A | * | 11/1994 | Wataya | 477/107 |
| 6,073,610 A | * | 6/2000 | Matsumoto et al. | 123/396 |
| 6,491,022 B2 | * | 12/2002 | Okamoto | 123/396 |

FOREIGN PATENT DOCUMENTS

| | | |
|---|---|---|
| JP | A 1-277652 | 11/1989 |
| JP | A 3-23337 | 1/1991 |
| JP | A 4-330331 | 11/1992 |
| JP | U 6-18661 | 3/1994 |
| JP | A 10-141126 | 5/1998 |

* cited by examiner

*Primary Examiner*—Bibhu Mohanty
(74) *Attorney, Agent, or Firm*—Oliff & Berridge PLC

(57) ABSTRACT

In a control system of an internal combustion engine including an intake flow control valve disposed downstream of a throttle valve, a controller controls opening and closing of the intake flow control valve, depending upon an operating state of the internal combustion engine. Upon detection of a failure in the intake flow control valve, the controller controls an intake air amount or flow rate to a different value.

24 Claims, 4 Drawing Sheets

CONTROL SYSTEM AND METHOD FOR INTERNAL COMBUSTION ENGINE

INCORPORATION BY REFERENCE

The disclosure of Japanese Patent Application No. 2001-129725 filed on Apr. 26, 2001, including the specification, drawings and abstract, is incorporated herein by reference in its entirety.

BACKGROUND OF THE INVENTION

1. Field of Invention

The invention relates to control systems and methods of an internal combustion engine, for controlling opening and closing of an intake flow control valve disposed downstream of a throttle valve in an intake pipe, depending upon an operating state of the engine.

2. Description of Related Art

An intake control system of an internal combustion engine is known which controls opening and closing of an intake flow control valve disposed downstream of a throttle valve within an intake pipe, depending upon an operating state of the engine. The intake control system of this type operates to close the intake flow control valve, for example, upon a start of the engine with a light load, to thus reduce an effective cross-sectional area of a portion of the intake pipe in which the control valve is mounted, thereby restricting flow of intake air through that portion of the intake pipe. With this control, the flow velocity of the intake air passing downstream of the intake flow control valve is increased, and the magnitude of a negative pressure as measured in the intake pipe downstream of the valve is increased. As a result, atomization of fuel that is injected into the intake pipe by an injector disposed downstream of the intake flow control valve is promoted, and turbulence is created in a combustion chamber, thus leading to an improvement of combustion characteristics of the engine.

An intake control system as disclosed in Japanese laid-open Patent Publication No. 10-141126 is operable to detect an abnormality or failure in the intake flow control valve that is placed in the open or closed position, and to perform fail-safe control of the internal combustion engine by controlling the fuel injection amount and the injection timing upon detection of an abnormality in the intake flow control valve. However, the control system is not arranged to control the intake flow amount or flow rate in such a situation.

SUMMARY OF THE INVENTION

It is therefore one object of the invention to provide a control system of an internal combustion engine, which controls the intake air amount or flow rate upon detection of an abnormality in the open or closed position of an intake flow control valve, so as to stabilize combustion of an air-fuel mixture in a combustion chamber.

To accomplish the above and/or other object(s), there is provided according to one aspect of the invention, a control system of an internal combustion engine including an intake flow control valve disposed downstream of a throttle valve, comprising a controller that (1) controls opening and closing of the intake flow control valve, depending upon an operating state of the internal combustion engine, (2) detects a failure of the intake flow control valve that is placed in an open position when control for closing the intake flow control valve is performed, and (3) controls an intake air amount to an increased value when the failure is detected, so as to stabilize combustion of an air-fuel mixture in the engine.

In the internal combustion engine equipped with the intake flow control valve, the intake air amount during idling and the fuel injection amount at the time of a cold start of the engine are normally set to smaller values than those for an engine having no intake flow control valve, and the air/fuel ratio of an air-fuel mixture to be burned is set to be on the lean side, in view of an effect of improving combustion characteristics through an operation of the intake flow control valve. If the intake flow control valve is placed in the open position due to a failure, therefore, the intake air amount during idling becomes insufficient, and needs to be increased. According to the above aspect of the invention, the intake air amount is controlled to an increased value upon a failure of the intake flow control valve, thus assuring a sufficiently high idling speed and stabilized combustion.

It is preferable to increase a fuel injection amount and/or advance an injection timing, as well as increasing the intake air amount, when the intake flow control valve is placed in an open position due to a failure.

According to another aspect of the invention, there is provided a control system of an internal combustion engine including an intake flow control valve disposed downstream of a throttle valve, comprising a controller that (1) controls opening and closing of the intake flow control valve, depending upon an operating state of the internal combustion engine, (2) detects whether the intake flow control valve is sticking at a certain opening angle, and (3) when detecting sticking of the intake flow control valve, controls opening and closing of the throttle valve in accordance with a degree of sticking of the intake flow control valve.

When the intake flow control valve is stuck at a certain position or opening angle, flow of intake air through the intake pipe is restricted by the intake flow control valve, and it becomes difficult to insure that a sufficiently large amount of intake air is supplied to the combustion chamber. According to the above aspect of the invention, therefore, opening and closing of the throttle valve is controlled so as to ensure a sufficiently large amount of intake air.

Here, it is preferable to correct an opening angle of the throttle valve in relation to an amount of depression of an accelerator pedal, in accordance with the degree of sticking of the intake flow control valve.

BRIEF DESCRIPTION OF THE DRAWINGS

The foregoing and/or further objects, features and advantages of the invention will become more apparent from the following description of a preferred embodiment with reference to the accompanying drawings, in which like numerals are used to represent like elements and wherein.

DETAILED DESCRIPTION OF PREFERRED EMBODIMENTS

Figure 1:
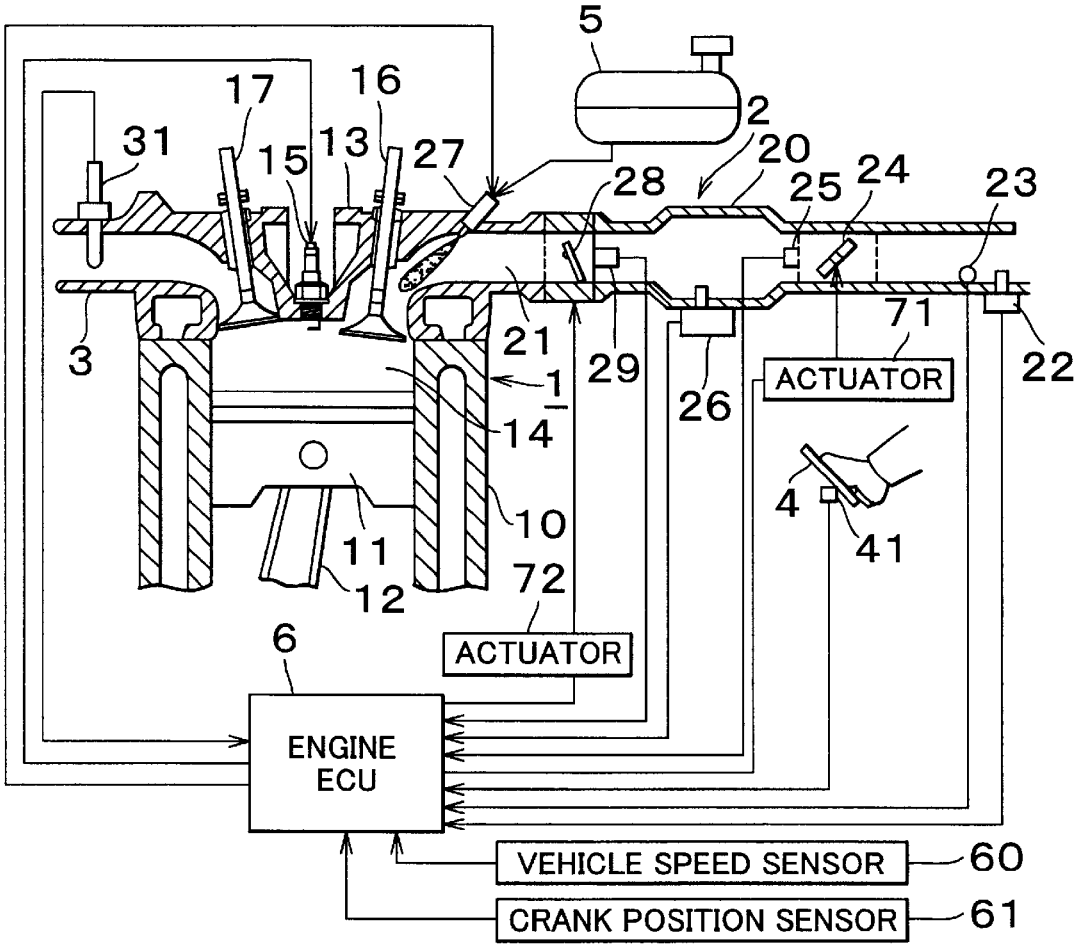
FIG. 1 is a schematic view of the structure of an internal combustion engine provided with an intake control system according to one preferred embodiment of the invention.

FIG. 1 schematically shows an internal combustion engine that employs a control system according to one preferred embodiment of the invention. The internal combustion engine is in the form of a spark ignition type multi-cylinder gasoline engine 1 (hereinafter simply called "internal combustion engine") to which an intake pipe 2 and an exhaust pipe 3 are connected. Within the intake pipe 2, there are provided an intake air temperature sensor 22 for detecting a temperature of intake air, an air flow meter 23 for detecting an intake air amount or flow rate, a throttle valve 24, and a throttle opening sensor 25 for detecting an opening angle of the throttle valve 24. The throttle valve 24 is connected to an actuator 71, and driving of the actuator 71 is controlled by an engine ECU 6 which will be described later, according to an amount of depression of an accelerator pedal 4 (which is detected by an accelerator position sensor 41). Thus, the throttle valve 24, the actuator 71, and the engine ECU 6 provide a so-called electronic throttle control system.

Also, an intake air pressure sensor 26 for detecting a pressure in the intake pipe 2 is disposed in a surge tank 20 of the intake pipe 2. Further, an electromagnetically driven injector (a fuel injection device) 27 is disposed in an intake port 21 connected to each cylinder 10 of the internal combustion engine 1, and gasoline as one type of fuel is supplied from a fuel tank 5 to the injector 27. The internal combustion engine 1 as shown in FIG. 1 employs a multi-point injection system in which the injector 27 is provided for each of the cylinders 10 of the engine. In other words, independent injectors 27 are provided for respective cylinders of the engine.

An intake flow control valve 28 is provided between the surge tank 20 and the intake port 21. The intake flow control valve 28 shown in FIG. 1 is placed in a closed state in which the intake pipe 2 is partially closed so that the effective cross-sectional area of the intake pipe 2 is reduced (i.e., flow of the intake air through the valve 28 is restricted). An actuator 72 for opening/closing the intake flow control valve 28 is connected to the intake flow control valve 28. Also, an opening sensor 29 for detecting an opening angle of the intake flow control valve 28 is disposed in the vicinity of the intake flow control valve 28 within the intake pipe 2.

A piston 11 is received in each of the cylinders 10 of the internal combustion engine 1, such that the piston 11 can reciprocate within the cylinder 10 in a vertical direction in FIG. 1. The piston 1 is connected to a crankshaft (not shown in FIG. 1), via a connecting rod 12. A combustion chamber 14, which is formed above the piston 11, is partially defined by the cylinder 10 and a cylinder head 13. A spark plug 15 is provided in an upper part of the combustion chamber 14, and the combustion chamber 14 is connected to the intake pipe 2 and the exhaust pipe 3 via an intake valve 16 and an exhaust valve 17, respectively. Also, an air-fuel ratio sensor 31 is provided in the exhaust pipe 3, for generating an electric signal whose level is proportional to the oxygen concentration of exhaust gas passing through the exhaust pipe 3.

The engine ECU 6 for controlling the internal combustion engine 1 includes a microcomputer as a main component, and receives output signals from the respective sensors as described above (i.e., intake air temperature sensor 22, air flow meter 23, throttle opening sensor 25, intake air pressure sensor 26, air-fuel ratio sensor 31, and accelerator position sensor 41). The engine ECU 6 also receives output signals from a vehicle speed sensor 60 and a crank position sensor 61, and controls operations of the spark plug 15, the injector 27 and the actuators 71 and 72.

Figure 2:
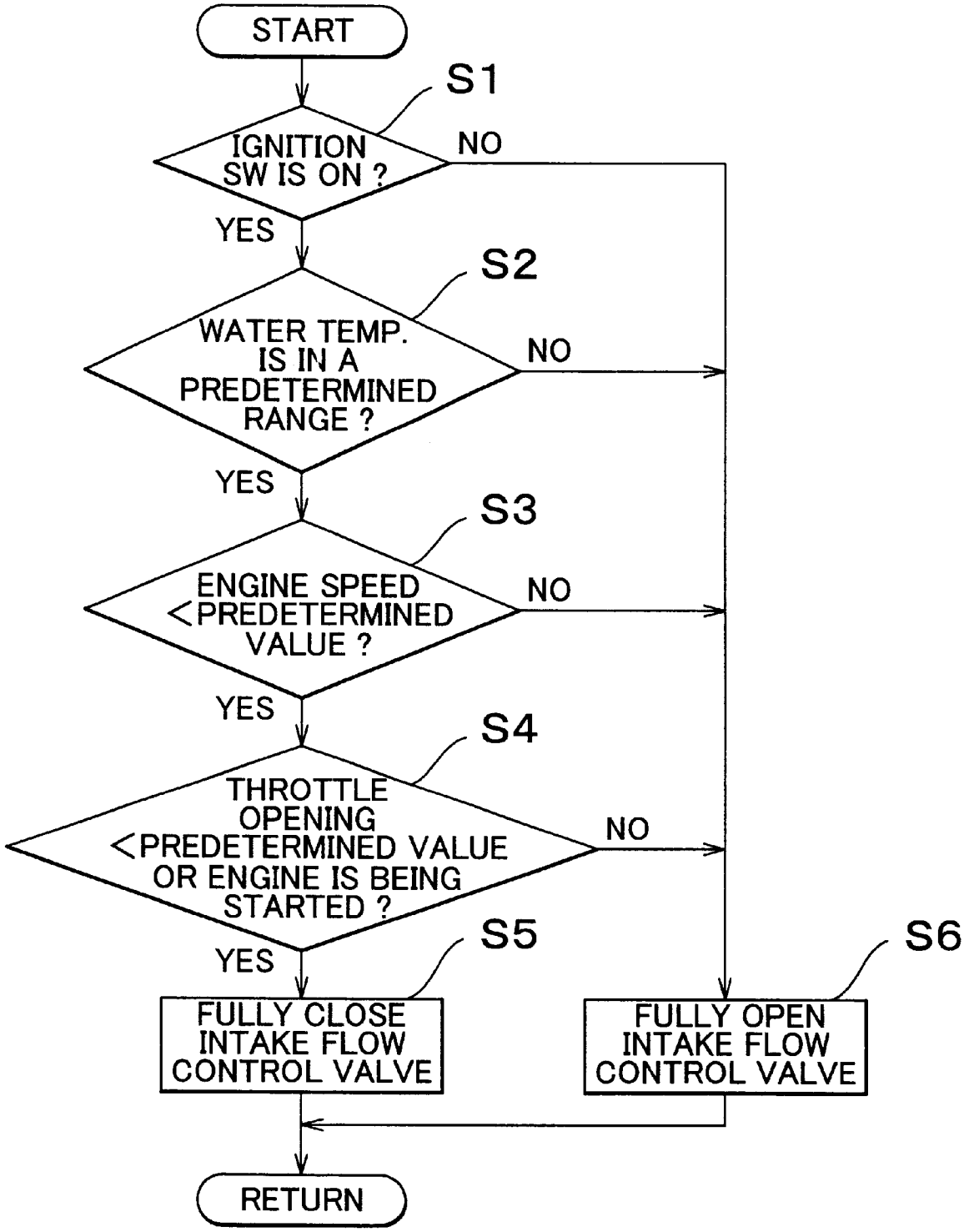
FIG. 2 is a flowchart for explaining basic operations of the intake control system shown in FIG. 1.

Next, a basic control operation of the control system for the internal combustion engine according to the present embodiment of the invention will be described. FIG. 2 is a flowchart for explaining the control operation. The control is repeatedly performed by the engine ECU 6 in predetermined timing after a power supply system of the vehicle is turned on.

In steps S1 through S4, it is determined whether intake flow control conditions as described below are satisfied. If all the conditions are satisfied, the engine ECU 6 determines that the intake flow control should be performed, and proceeds to step S5. Conversely, if any of the conditions is not satisfied, the engine ECU 6 determines that the intake flow control need not be performed, and proceeds to step S6.

The above-indicated conditions for the intake flow control are: (1) an ignition switch is ON (step S1), (2) a water temperature is within a predetermined range (step S2), (3) an engine speed is lower than a predetermined value (step S3), (4) a throttle opening (opening amount) is smaller than a predetermined value or the engine is being started (step S4).

In the case where all of the above conditions are met, that is, during a cold start or idling immediately after an engine start, the engine ECU 6 proceeds to step S5 to control the actuator 72 so as to set or place the intake flow control valve 28 in a fully closed position.

When the intake flow control valve 28 is closed, the effective cross-sectional area of the intake pipe 2 is reduced, whereby the magnitude of a negative pressure measured in a portion of the intake pipe 2 downstream of the intake flow control valve 28 is increased. (Note that the valve 28 does not completely block flow through pipe 2 even when the valve 28 is in the closed position.) With the negative pressure thus increased, atomization of fuel that is sprayed from the injector 27 is promoted, and therefore the fuel is less likely to adhere to the inner wall of the intake pipe 2. Furthermore, the flow of the intake air through the intake pipe 2 is localized and accelerated at the intake flow control valve 28 placed in the closed position, so that turbulence is created in the combustion chamber 11. The turbulence thus formed in the combustion chamber 11 leads to improved combustion stability, and permits combustion of a fuel-lean air-fuel mixture (i.e., lean-burn), which results in a reduction in exhaust emissions. Thus, the combustion characteristics are improved by closing the intake flow control valve 28.

On the other hand, if any of the above-indicated conditions is not met, the control proceeds to step S6 to control the actuator 72 so as to set the intake flow control valve 28 in a fully open position. In this case, the combustion characteristics are not improved by using the intake flow control valve 28.

Figure 3:
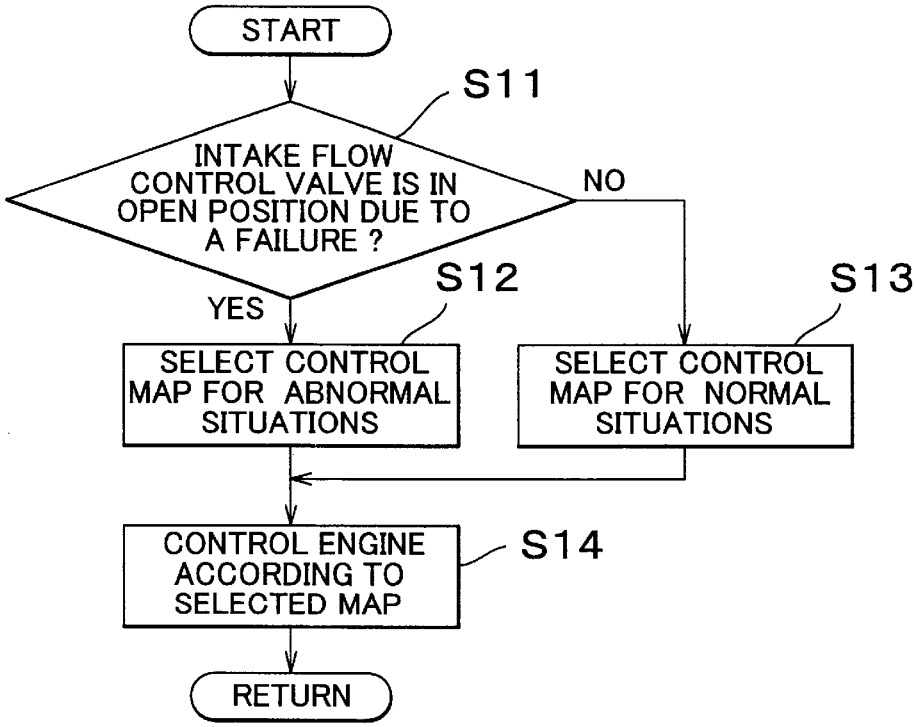
FIG. 3 is a flowchart illustrating a control routine executed when a failure of an intake flow control valve in the intake control system of FIG. 1 is detected.

Next, some examples of control performed upon a failure of the intake flow control valve 28 will be described. FIG. 3 is a flowchart showing an example of control performed when the intake flow control valve 28 is placed in the open position even though it should be controlled to the closed position. This control is executed following step S5 of the control routine of FIG. 2.

In step S11, it is first determined whether the intake flow control valve 28 is in the open position due to a failure even though control for setting the intake flow control valve 28 in the closed position is being performed. This determination is made on the basis of an output from the opening sensor 29. If it is determined in step S11 that the intake flow control valve 28 is in the open position in spite of the control, the engine ECU 6 executes step S12 to select, as control maps used for determining the intake air amount during idling, the fuel injection amount and the ignition timing, corrected maps to be used in the case of a failure of the intake flow control valve 28. Conversely, if it is determined in step S11 that the intake flow control valve 28 is not in the open position but in the closed position under the control, the engine ECU 6 executes step S13 to select control maps to be used in normal situations, for determining the intake air amount during idling, the fuel injection amount, and the ignition timing. In step S14, the internal combustion engine is controlled according to the selected control maps.

The corrected maps used upon a failure of the intake flow control valve 28 are preferably plotted such that the intake air amount during idling is increased, and the fuel injection amount is increased and/or the injection timing is advanced, as compared with the control maps used in normal situations (i.e., when the valve 28 is operating normally). The intake air amount during idling may be increased by controlling the actuator 71 to increase an opening angle of the throttle valve 24. Also, in the case where a bypass passage is provided in addition to a passage (defined by the intake pipe 2) in which the throttle valve 24 is disposed, and an idle-speed control valve is disposed in the bypass passage, the intake air amount during idling may be increased by controlling an opening of the idle-speed control valve to an increased degree as compared with that established in normal situations.

If the intake flow control valve 28 is kept in the closed position upon a cold start, or the like, when the combustion characteristics need to be improved, the fuel tends to adhere to the inner wall of the intake pipe 2, resulting in a shortage of the fuel injection amount and a higher possibility of rough idling. According to the above-described embodiment, when an abnormal open state of the intake flow control valve 28 is detected, the intake air amount is increased so as to accelerate vaporization of the fuel and prevent adhesion of the fuel to the inner wall of the intake pipe 2. Furthermore, when the intake flow control valve 28 is in the open position due to a failure, turbulence cannot be created sufficiently in the combustion chamber 14, and an intended effect of improving combustion characteristics cannot be obtained. In this case, therefore, the fuel injection amount is increased so as to eliminate the insufficiency of the fuel, and the injection timing is advanced so as to ensure a sufficient combustion time or period, thereby to permit satisfactory combustion with a fuel-lean air-fuel mixture (i.e., lean-burn). According to the present embodiment of the invention, therefore, it is possible to avoid or suppress deterioration of the driveability, such as rough idling or a decrease in the idle speed, upon combustion of a fuel-lean air-fuel mixture at the time of an engine start, even if the intake flow control valve 28 is placed in the open position due to a failure.

While the control maps for normal situations or the corrected control maps for abnormal situations are selected depending upon whether the intake flow control valve 28 is opened due to a failure in the illustrated embodiment, only correction coefficients for use in abnormal situations may be stored in the form of maps or functions in a memory within the engine ECU 6, so that the intake air amount, the fuel injection amount, and the injection timing are corrected using the correction coefficients. In this case, the storage capacity of the memory of the engine ECU 6 can be advantageously reduced.

Figure 4:
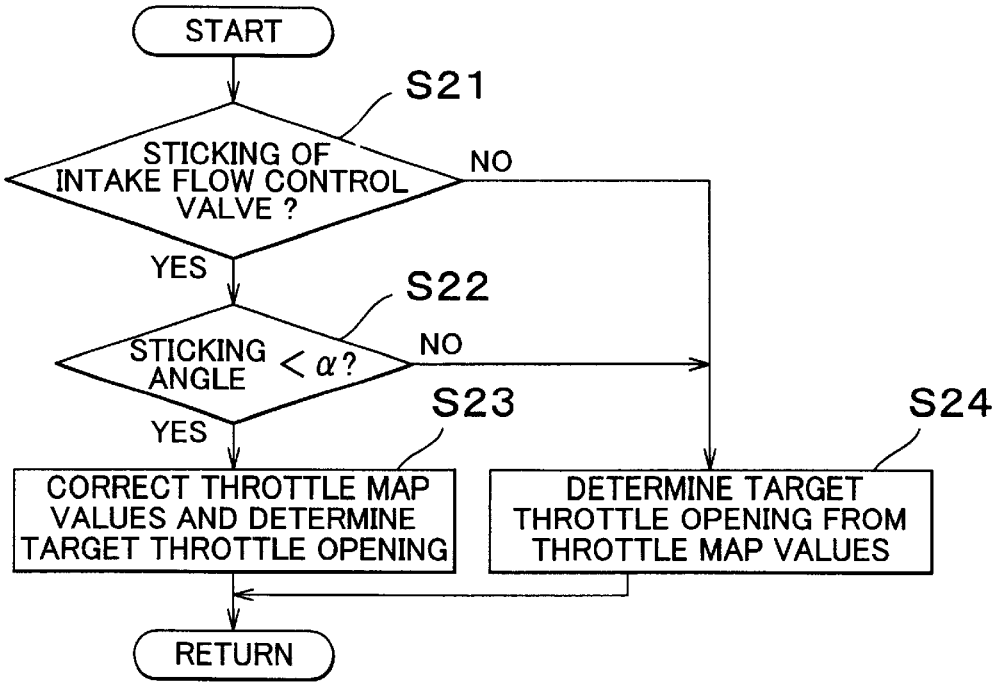
FIG. 4 is a flowchart illustrating a control routine executed when a failure (i.e., sticking) of the intake flow control valve in the intake control system of FIG. 1 is detected.

FIG. 4 is a flowchart showing an example of control performed when the intake flow control valve 28 is in a sticking condition, namely, when the valve 28 is stuck in the closed position due to a failure. This control is performed following step S6 of the control routine of FIG. 2.

In step S21, it is first determined from an output signal of the opening sensor 29 whether the intake flow control valve 28 is in the fully open position according to the control of step S6. If the intake flow control valve 28 does not achieve the opening angle set in step S6 of the control routine of FIG. 2, it is determined that the intake flow control valve 28 is in a sticking, faulty condition. In this situation, the engine ECU 6 proceeds to step S22 to determine whether the current sticking angle, namely, a difference between the current opening angle of the intake flow control valve 28 and the opening angle of the valve 28 when it is in the fully closed position, is smaller than a predetermined value $\alpha$. Conversely, when it is determined that the intake flow control valve 28 is not in the sticking faulty condition, the engine ECU 6 proceeds to step S24.

If step S22 determines that the sticking angle is equal to or greater than the predetermined value $\alpha$, the intake flow control valve 28, having a sufficiently large opening angle, is supposed to be in the fully open position even though the valve 28 is actually in a sticking condition. In this case, the control proceeds to step S24 as in the case where it is determined in step S21 that the intake flow control valve 28 is not in the sticking faulty condition. In step S24, the actuator 71 is controlled so as to set the opening of the throttle valve 24 to a target opening angle, which is set by using a map representing the relationship between an amount of depression of the accelerator pedal (or accelerator position) and the target throttle opening of the electronically driven throttle valve 24.

If it is determined in step S22 that the sticking angle is less than the predetermined value $\alpha$, on the other hand, the control proceeds to step S23 so as to correct the map values in the above-described map of the accelerator-pedal depression amount and the target throttle opening, in accordance with the sticking angle, and to obtain the target throttle opening based on the accelerator-pedal depression amount detected by the accelerator position sensor 41. Then, the actuator 71 is controlled so as to set the opening of the throttle valve 24 to the target throttle opening thus determined.

Figure 5A:
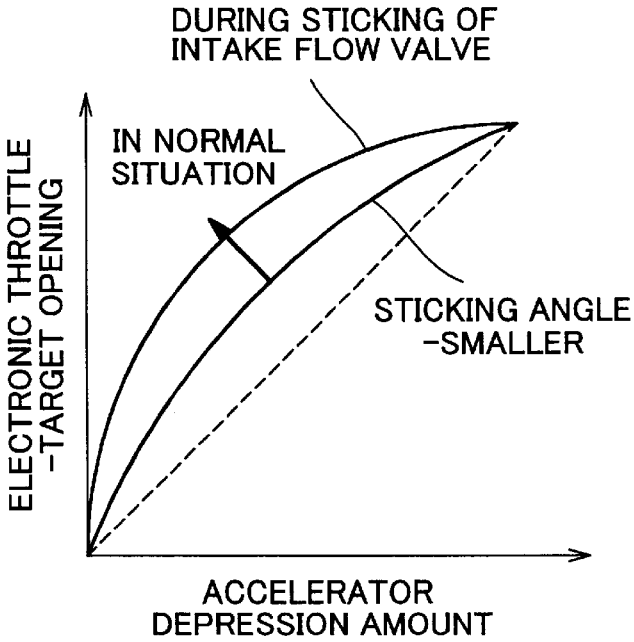
FIG. 5A and FIG. 5B are graphs that respectively show examples of a relationship between the accelerator-pedal depression amount and the target opening of an electronic throttle for use in the control of FIG. 4.
Figure 5B:
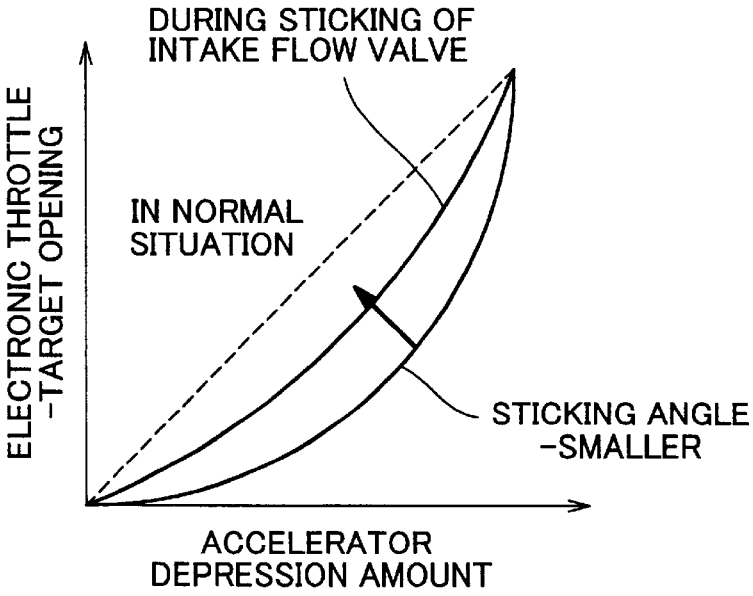

In most cases, the relationship between the accelerator-pedal depression amount and the target throttle opening of the electronic throttle valve is represented by a nonlinear map as shown in FIG. 5A or FIG. 5B. In either case of FIG. 5A and FIG. 5B or even in the case where a linear map (not shown) is used, as the sticking angle (i.e., a difference between the current opening angle and the minimum opening angle) decreases and the effect of closing the intake pipe 2 by the intake flow control valve 28 increases, the target opening angle of the electronic throttle valve 24 is set to the larger degree than that established when the valve 28 is operating normally. By controlling the throttle valve 24 to the larger opening angle, it is possible to ensure a required amount of intake air, and allow the driver to adjust an engine load by operating the accelerator pedal in the same manner as when the intake flow control valve 28 is in the normal condition, thus assuring improved driveability.

In the illustrated embodiment, a failure of the intake flow control valve 28, such as the opening state of the valve 28 kept in spite of closing control, or the sticking condition of the valve 28, is detected by the opening sensor 29. However, the opening angle of the intake flow control valve 28 may be estimated based on a negative pressure in the intake pipe or the air-fuel ratio, and the opening state of the valve 28 or the sticking condition of the valve 28 may be determined based on the estimated opening angle of the valve 28.

According to the embodiment as described above, even in the case where the intake flow control valve is kept in an open position or at a certain opening due to a failure thereof, the throttle valve, or the like, is controlled so as to eliminate a shortage or insufficiency of intake air. Since a sufficient amount of intake air is thus supplied to the combustion chamber, rough idling can be avoided which would otherwise occur due to a reduction in the idling speed upon a start of the engine, and the accelerator pedal need not be depressed by an extra degree after the engine starts, thus assuring improved driveability.

In the illustrated embodiment, the apparatus is controlled by the controller (e.g., the ECU 6), which is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A control system of an internal combustion engine including an intake flow control valve disposed downstream of a throttle valve, the control system comprising a controller that:

controls opening and closing of the intake flow control valve, depending upon an operating state of the internal combustion engine;

detects a failure of the intake flow control valve to operate properly; and controls an intake air amount to a first value when the failure is not detected, and controls the intake air amount to a second value when the failure is detected, the second value being different from the first value.

2. The control system according to claim 1, wherein the controller controls the throttle valve in order to control the intake air amount.

3. The control system according to claim 1, wherein the second value is greater than the first value.

4. A control system of an internal combustion engine including an intake flow control valve disposed downstream of a throttle valve, the control system comprising a controller that:

controls opening and closing of the intake flow control valve, depending upon an operating state of the internal combustion engine;

detects a failure of the intake flow control valve to close properly when control for closing the intake flow control valve from an open position is performed; and controls an intake air amount to an increased value when the failure is detected, so as to stabilize combustion of an air-fuel mixture in the engine.

5. The control system according to claim 4, wherein the controller performs at least one of control operations to increase a fuel injection amount and advance an injection timing, in addition to increasing the intake air amount.

6. The control system according to claim 5, wherein the controller stores at least one control map to be used upon the failure of the intake flow control valve, for determining at least one of the intake air amount, the fuel injection amount and the injection timing.

7. The control system according to claim 4, wherein the controller increases the intake air amount by increasing an opening angle of the throttle valve.

8. A control system of an internal combustion engine including an intake flow control valve disposed downstream of a throttle valve, the control system comprising a controller that:

controls opening and closing of the intake flow control valve, depending upon an operating state of the internal combustion engine;

detects whether the intake flow control valve is sticking at a certain opening angle; and when detecting the sticking of the intake flow control valve, controls opening and closing of the throttle valve in accordance with a degree of sticking of the intake flow control valve.

9. The control system according to claim 8, wherein an opening angle of the throttle valve in relation to an amount of depression of an accelerator pedal is corrected in accordance with the degree of sticking of the intake flow control valve.

10. The control system according to claim 8, wherein the degree of sticking of the intake flow control valve is represented by a difference between a current opening angle and a minimum opening angle of the intake flow control valve.

11. The control system according to claim 10, wherein the sticking of the intake flow control valve is detected when the difference is smaller than a predetermined value.

12. A control method of an internal combustion engine including an intake flow control valve disposed downstream of a throttle valve, the control method comprising the steps of:

controlling opening and closing of the intake flow control valve, depending upon an operating state of the internal combustion engine;

detecting a failure of the intake flow control valve to operate properly; and controlling an intake air amount to a first value when the failure is not detected, and controlling the intake air amount to a second value when the failure is detected, the second value being different from the first value.

13. The control method according to claim 12, wherein the throttle valve is controlled in order to control the intake air amount.

14. The control method according to claim 12, wherein the second value is greater than the first value.

15. A control method of an internal combustion engine including an intake flow control valve disposed downstream of a throttle valve, the control method comprising the steps of:

controlling opening and closing of the intake flow control valve, depending upon an operating state of the internal combustion engine;

detecting a failure of the intake flow control valve to close properly when control for closing the intake flow control valve from an open position is performed; and controlling an intake air amount to an increased value when the failure is detected, so as to stabilize combustion of an air-fuel mixture in the engine.

16. The control method according to claim 15, wherein at least one of control operations to increase a fuel injection amount and advance an injection timing is performed, in addition to increasing the intake air amount.

17. The control method according to claim 16, wherein at least one control map to be used upon the failure of the intake flow control valve is employed for determining at least one of the intake air amount, the fuel injection amount and the injection timing.

18. The control method according to claim 15, wherein the intake air amount is increased by increasing an opening angle of the throttle valve.

19. A control method of an internal combustion engine including an intake flow control valve disposed downstream of a throttle valve, the control method comprising the steps of:

controlling opening and closing of the intake flow control valve, depending upon an operating state of the internal combustion engine;

detecting whether the intake flow control valve is sticking at a certain opening angle; and when the sticking of the intake flow control valve is detected, controlling opening and closing of the throttle valve in accordance with a degree of sticking of the intake flow control valve.

20. The control method according to claim 19, wherein an opening angle of the throttle valve in relation to an amount of depression of an accelerator pedal is corrected in accordance with the degree of sticking of the intake flow control valve.

21. The control method according to claim 19, wherein the degree of sticking of the intake flow control valve is represented by a difference between a current opening angle and a minimum opening angle of the intake flow control valve.

22. The control method according to claim 21, wherein the sticking of the intake flow control valve is detected when the difference is smaller than a predetermined value.

23. The control system according to claim 1, wherein the intake flow control valve is disposed in an intake pipe upstream of an intake valve of the internal combustion engine.

24. The control method according to claim 12, wherein the intake flow control valve is disposed in an intake pipe upstream of an intake valve of the internal combustion engine.

* * * * *